United States Patent [19]

Schellhorn

[11] Patent Number: 4,958,962

[45] Date of Patent: Sep. 25, 1990

[54] METHODS OF MODIFYING THE STRUCTURAL INTEGRITY OF SUBTERRANEAN EARTH SITUS

[75] Inventor: Verne L. Schellhorn, Gualala, Calif.

[73] Assignee: Halliburton Company, Duncan, Okla.

[21] Appl. No.: 373,351

[22] Filed: Jun. 28, 1989

[51] Int. Cl.[5] ..... E02D 3/12

[52] U.S. Cl. ..... 405/267; 405/263; 405/269

[58] Field of Search ..... 405/266, 267, 263, 269, 405/258, 233, 231, 232; 175/393

[56] References Cited

U.S. PATENT DOCUMENTS

| | | | |
|---|---|---|---|
| 512,037 | 1/1894 | Kraus . | |
| 1,313,013 | 8/1919 | Polysu . | |
| 1,665,798 | 4/1928 | Sipe . | |
| 1,734,672 | 11/1929 | Harralson . | |
| 1,904,079 | 4/1933 | Powell . | |
| 2,129,978 | 9/1938 | Yokoyama . | |
| 2,199,692 | 5/1940 | Catland . | |
| 2,218,130 | 10/1940 | Court . | |
| 2,354,936 | 8/1944 | Bignell . | |
| 2,357,835 | 9/1944 | Leissler . | |
| 2,582,312 | 1/1952 | Del'Homme . | |
| 2,782,605 | 2/9157 | Wertz et al. . | |
| 2,923,133 | 2/1960 | Muller . | |
| 2,924,948 | 2/1960 | Mueller . | |
| 3,023,585 | 3/1962 | Liver . | |
| 3,097,492 | 7/1963 | Salassi . | |
| 3,099,911 | 8/1963 | Turzillo . | |
| 3,206,935 | 9/1965 | Phares . | |
| 3,354,656 | 11/1967 | Fahenstock . | |
| 3,354,657 | 11/1967 | Turzillo . | |
| 3,363,422 | 1/1968 | Turzillo . | |
| 3,363,706 | 1/1968 | Feenstra . | |
| 3,369,617 | 2/1968 | Brack et al. . | |
| 3,410,095 | 11/1968 | Turzillo et al. . | |
| 3,426,538 | 2/1969 | Turzillo . | |
| 3,429,126 | 2/1969 | Wey . | |
| 3,453,832 | 7/1969 | Rehmar . | |
| 3,464,216 | 9/1969 | Turzillo . | |
| 3,470,701 | 10/1969 | Turzillo . | |
| 3,485,052 | 12/1969 | Turzillo . | |
| 3,504,497 | 4/1970 | Turzillo . | |
| 3,529,428 | 9/1970 | Batten . | |
| 3,530,675 | 9/1970 | Turzillo . | |
| 3,563,324 | 2/1971 | Lauber . | |
| 3,604,214 | 9/1971 | Turzillo . | |
| 3,685,303 | 8/1972 | Turzillo . | |
| 3,753,597 | 8/1973 | French . | |
| 3,786,641 | 1/1974 | Turzillo . | |
| 3,800,544 | 4/1974 | Nakanishi | 405/266 |
| 3,802,203 | 4/1974 | Ichise et al. . | |
| 3,802,208 | 4/1974 | Granholm et al. . | |
| 3,842,608 | 10/1974 | Turzillo . | |
| 3,864,923 | 2/1975 | Turzillo . | |
| 3,935,910 | 2/1976 | Gaudy et al. . | |
| 3,938,344 | 2/1976 | Asayama . | |
| 3,962,879 | 6/1976 | Turzillo . | |
| 3,969,902 | 7/1976 | Ichise et al. . | |
| 4,063,424 | 12/1977 | Takagi et al. . | |
| 4,084,648 | 4/1978 | Yakiro . | |
| 4,126,007 | 11/1978 | Mars | 405/271 |
| 4,180,350 | 12/1979 | Watts | 405/233 |
| 4,212,565 | 7/1980 | Watabe | 405/269 |
| 4,229,122 | 10/1980 | Ballantyne | 405/258 |
| 4,302,132 | 11/1981 | Ogawa et al. | 405/269 |
| 4,303,136 | 12/1981 | Ball | 175/329 |
| 4,327,507 | 5/1982 | Volbeda | 37/67 |
| 4,433,943 | 2/1984 | Pao Chen | 405/241 |
| 4,452,324 | 6/1984 | Jurgens | 175/393 |
| 4,452,551 | 6/1984 | Arndt et al. | 405/266 X |
| 4,514,112 | 4/1985 | Sano et al. | 405/269 |
| 4,515,227 | 5/1985 | Cerkovnik | 175/65 |
| 4,540,316 | 9/1985 | Takahashi | 405/266 X |
| 4,601,613 | 7/1986 | Wolf | 405/239 |
| 4,637,758 | 1/1987 | Tamaki et al. | 405/248 |
| 4,659,257 | 4/1987 | Verstraeten | 405/248 |
| 4,793,740 | 12/1988 | Schellhorn | 405/232 |

*Primary Examiner*—Dennis L. Taylor

*Attorney, Agent, or Firm*—Robert A. Kent; Clark Dougherty

[57] ABSTRACT

A method of modifying the structural integrity of material in a subterranean earth situs. The method comprises the steps of mechanically digging into the situs to break the material into pieces and, simultaneously, hydraulically admixing a modifying agent with the pieces by introducing the modifying agent into the pieces at a velocity in the range of from about 300 ft./sec. to about 2500 ft./sec. The method is particularly suitable for improving the strengh and load-bearing capacity of material in a subterranean earth situs. Also provided is a method of modifying the stuctural integrity of material in a subterranean earth situs and installing a pre-formed structural element therein.

13 Claims, 2 Drawing Sheets

METHODS OF MODIFYING THE STRUCTURAL INTEGRITY OF SUBTERRANEAN EARTH SITUS

BACKGROUND OF THE INVENTION

1. Field of the Invention.

The present invention relates to methods of modifying the structural integrity of subterranean earth situs, to methods of strengthening and improving the load-bearing capacity of subterranean earth situs and to methods of installing structural elements in subterranean earth situs.

2. Description of the Prior Art.

A variety of methods for improving the strength and reducing the permeability of subterranean earth situs have been developed heretofore. Typically, the soil in the situs is loosened and a solidifying agent is admixed therewith, in situ. This is most commonly carried out by drilling an auger-type tool into the situs to loosen the soil and pumping the solidifying agent into the soil through the shaft of the tool. The solidifying agent is typically admixed with the soil by the mechanical action of mixing paddles attached to the tool or the auger flight upon rotation of the tool. The tool is then withdrawn from the situs with or without excavating soil therefrom. The solidifying agent/soil admixture is allowed to harden into a solidified mass. If desired, a structural element can be installed in the situs before the solidifying agent/soil admixture hardens. The resulting element and/or solidified mass can be used to support roadways, bridges, piers, buildings and the like.

Although the methods developed heretofore are effective in many applications, the mechanical action of mixing paddles or the auger flight is not always sufficient to uniformly admix the solidifying agent with the soil. The resultant admixture is slow in setting up and often has poor structural properties. Solidifying agent-/soil admixtures having nonuniform consistencies are difficult to work with.

Furthermore, in most of the methods developed heretofore, the strength and load-bearing capacity of the pile and/or solidified soil cannot be determined until after the solidifying agent/soil admixture hardens and load capacity tests are carried out thereon. There is no way to accurately determine the amount of energy required to achieve a sufficient mix. In order to allow for variations in the consistency of the soil from point to point within the situs, the overall extent of solidification carried out is often more than necessary resulting in a waste of labor and materials.

By the present invention, a method of modifying the structural integrity of material in a subterranean earth situs is provided. In accordance with the method, the structural integrity of material in the situs can be either decreased or increased. The method is particularly suitable for increasing the load-bearing capacity of a subterranean earth situs and installing structural elements such as piles, piers and tension anchors therein. A very uniform admixture of a modifying agent and the material in the situs is achieved. The load-bearing capacity of the material in the situs can be determined before and as the method is carried out allowing the overall extent of modification from point to point within the situs to be accurately controlled.

SUMMARY OF THE INVENTION

In one aspect, the present invention provides a method of modifying the structural integrity of material in a subterranean earth situs. The method comprises the steps of mechanically digging into the situs to break the material into pieces and, while digging into the situs, hydraulically admixing a modifying agent with the pieces by introducing the modifying agent into the pieces at a velocity in the range of from about 300 ft./sec. to about 2500 ft./sec. The material in the subterranean earth situs can be analyzed prior to and/or simultaneously with the digging and admixing steps to determine at least one property thereof. The rates of digging into the situs and introducing the modifying agent into the pieces can be regulated based on the analysis. In one embodiment, the step of mechanically digging into the situs to break the material into pieces is carried out by advancing a soil processing tool into the situs. The modifying agent is introduced into the pieces from the soil processing tool. The method is particularly suitable for improving the load-bearing capacity of material in a subterranean earth situs.

In a second aspect, the present invention provides a method of modifying the structural integrity of material in a subterranean earth situs and installing a preformed structural element therein. The structural integrity of material in the situs is modified in accordance with the method of the first aspect of the present invention. A soil processing tool is advanced into the situs to break the material into pieces and, while advancing the soil processing tool into the situs, a modifying agent is hydraulically admixed with the pieces by introducing the modifying agent into the pieces from the soil processing tool at a velocity in the range of from about 300 ft./sec. to about 2500 ft./sec. The material forming the situs can be analyzed prior to and/or simultaneously with the digging and admixing steps to determine at least one property thereof, and the rates of advancing the soil processing tool into the situs and introducing the modifying agent into the pieces can be regulated based on the analysis. Next, the soil processing tool is withdrawn from the situs leaving a cavity in the situs having a substantial portion of the admixture of modifying agent and material therein, and the preformed structural element is placed in the cavity whereby at least a portion of the admixture of the modifying agent and material is displaced by the element and forced between the element and the wall of the cavity.

The first aspect of the present invention can be used to decrease and/or increase the structural integrity of material in a subterranean earth situs. The method can be used to form an accurately engineered structural element such as a wall or pile, in situ, or can be used merely to stabilize a block of soil. The second aspect of the invention allows a preformed structural element of a known structural value such as a pre-stressed concrete pile, a pipe pile or an H-beam, to be installed in a structurally enhanced environment.

By introducing the modifying agent into the pieces at a velocity in the range of from about 300 ft./sec. to about 2500 ft./sec., a great deal of turbulence is created around the soil processing tool which divides the pieces into very fine particles and uniformly admixes the modifying agent therewith. By analyzing the material in the subterranean earth situs prior to and/or simultaneously with the digging and admixing steps to determine at least one property thereof and regulating the rates of digging into the situs and introducing a modifying agent into the pieces based on the analysis, the exact structural integrity imparted to a particular point in the situs can be accurately controlled. The overall load-bearing capacity of the situs can be determined as the methods are carried out thereby preventing wastage of unnecessary labor and materials. The final loadbearing capacity that a preformed structural element will have can be determined before the element is installed.

It is, therefore, a principal object of the present invention to provide an improved method of modifying the structural integrity of material in a subterranean earth situs and an improved method of installing a preformed structural element in a subterranean earth situs.

Numerous other objects, features, and advantages of the present invention will be readily apparent to those skilled in the art upon a reading of the following disclosure including the example provided therewith.

DESCRIPTION OF THE PREFERRED EMBODIMENTS

Figure 1:
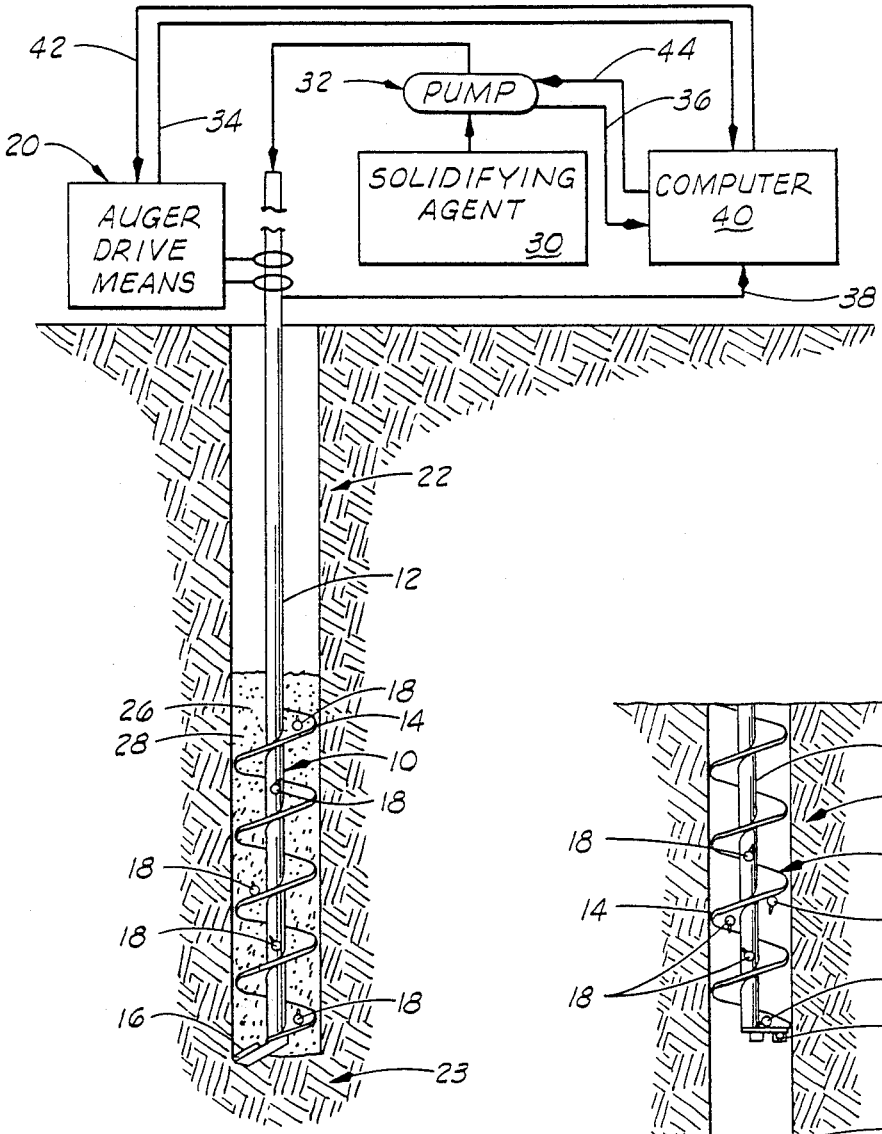
FIG. 1 illustrates rotation of a hollow-shafted auger into a subterranean earth situs in accordance with the methods of the present invention.

In a first aspect, the present invention provides a method of modifying the structural integrity of material in a subterranean earth situs. In a second aspect, the present invention provides a method of modifying the structural integrity of material in a subterranean earth situs and installing a preformed structural element therein. The method of the first aspect of the present invention is embodied in the method of the second aspect of the present invention.

As used herein and in the appended claims, a subterranean earth situs refers to an area of the earth below the surface of the earth. The material in a subterranean earth situs refers to everything in the situs including naturally occurring material such as soil, water and hydrocarbons and non-naturally occurring material such as sewage, garbage and other waste.

The method of modifying the structural integrity of material in a subterranean earth situs in accordance with the first aspect of the present invention comprises the steps of mechanically digging into the situs to break the material into pieces and, while digging into the situs, hydraulically admixing a modifying agent with the pieces by introducing the modifying agent into the pieces at a velocity in the range of from about 300 ft./sec. to about 2500 ft./sec. The material in the situs is analyzed prior to and/or simultaneously with the digging and admixing steps to determine at least one property thereof, and the rates of digging into the situs and introducing the modifying agent into the pieces can be separately regulated based on the analysis.

The method can be employed to modify the structural integrity of material in a subterranean earth situs both in a way that decreases the stability and load-bearing capacity of the material and in a way that improves the stability and load-bearing capacity of the material. Examples of modifying agents that can be used to decrease the stability and load-bearing capacity of material in a subterranean earth situs include various paraffins and asphaltic emulsions. Examples of modifying agents that can be used to increase the stability and load-bearing capacity of material in a subterranean earth situs include solidifying agents such as various pozzolans silicates, cements and clays, lime, flyash, kiln dust and mixtures thereof. Within the above group of solidifying agents, flyash and Portland cement are preferred. Portland cement is most preferred. If desired, various additives can be added to the modifying agent or agents employed to facilitate the method.

The step of mechanically digging into the environment to break the material into pieces is carried out by advancing a soil processing tool into the situs, and the modifying agent is preferably introduced into the pieces from the soil processing tool. The soil processing tool is a tool having at least one elongated hollow shaft and means for cutting the material in the situs into pieces attached thereto. A plurality of injection nozzles are attached to the shaft allowing the modifying agent to be pumped through the shaft and out the injection nozzles into the situs. Preferably, the soil processing tool is an auger having one or more hollow shafts, one or more helical flights, one or more cutting tips and a plurality of injection nozzles attached to the shafts and/or auger flights.

The modifying agent is preferably introduced into the pieces at a velocity in the range of from about 300 ft./sec. to about 2500 ft./sec. by pumping the modifying agent from a source thereof through the hollow shaft or shafts and injection nozzles of the soil processing tool and into the situs. By introducing the modifying agent into the pieces at a velocity in the range of from about 300 ft./sec. to about 2500 ft./sec., a great deal of turbulence is created around the soil processing tool which divides the pieces into very fine particles and uniformly admixes the modifying agent therewith. A great deal of energy can be put into a small volume of material allowing a very homogenous admixture to be formed, even with hard materials such as clay.

Preferably, the modifying agent is introduced into the pieces at a velocity in the range of from about 500 ft./sec. to about 1100 ft./sec., more preferably at a velocity in the the range of from about 500 ft./sec. to about 800 ft./sec. The pressure at which the modifying agent is introduced into the pieces at a given velocity varies depending on the nature of the agent and the coefficient of discharge of the agent from the injection nozzles into the pieces. For example, when the modifying agent is a Portland cement/water slurry having a density of 14.0 pounds per gallon and the coefficient of discharge of the agent from the injection nozzles into the pieces is 0.90, the pressure corresponds to the velocity as follows:

Velocity vs. Pressure
(14.0 lb./gal. - Cd = 0.90)

| Velocity (ft./sec.) | Pressure (psi) |
|---|---|
| 379 | 2000 |
| 535 | 4000 |
| 599 | 5000 |
| 628 | 5500 |
| 803 | 9000 |
| 1104 | 17000 |
| 1466 | 30000 |

When the modifying agent is a Portland cement/water slurry having a density of 12.5 pounds per gallon and the coefficient of discharge of the agent from the injection nozzles into the pieces is 0.95, the pressure corresponds to the velocity as follows:

| Velocity vs. Pressure (12.5 lb/gal. - Cd = 0.95) | |
|---|---|
| Velocity (ft./sec.) | Pressure (psi) |
| 423 | 2000 |
| 598 | 4000 |
| 669 | 5000 |
| 701 | 5500 |
| 897 | 9000 |
| 1233 | 17000 |
| 1638 | 30000 |

If desired, the injection nozzles of the soil processing tool can be positioned to introduce the modifying agent into material unbroken by the digging step as well as into the pieces of broken material. This allows a cavity having a diameter larger than the diameter of the soil processing tool to be formed in the situs. The orientation of the nozzles with respect to the pieces of material broken by the mechanical digging step can be adjusted to regulate the mechanical and hydraulic energy available in a way that achieves the most uniform admixture possible for the soil and subsurface conditions encountered.

The steps of analyzing the material prior to and/or simultaneously with the digging and admixing steps to determine at least one property thereof and separately regulating the rates of digging into the situs and introducing the modifying agent into the pieces based on the analysis allow the method to be very efficiently and effectively carried out. The amount of the modifying agent introduced into the pieces at a particular point in the situs can be regulated in accordance with the consistency of the soil at that point. The relative rates of mechanically digging into the situs to break the material into pieces and introducing the modifying agent into the pieces can be optimized depending on the type of material and subsurface conditions encountered allowing the overall amount of energy expended to be minimized.

The material in the situs can be analyzed prior to the digging and mixing steps by standard soil exploration techniques. The material in the situs can be analyzed simultaneously with the digging and mixing steps by sensors attached to the soil processing tool. The property or properties of the material determined by the analyses include, for example, the shear strength and frictional capacity of the material. The data generated by the analyses is fed into a computer which separately regulates the rates of advancing the soil processing tool into the situs and introducing the modifying agent into the pieces in accordance therewith. Thus, for example, at a point in the situs where the material has a relatively high load-bearing capacity, the rate of advancing the soil processing tool into the situs is increased and the velocity at which the modifying agent is introduced into the pieces is decreased. At a point in the situs where the material has a relatively low load-bearing capacity, the rate of advancing the soil processing tool into the situs is decreased and the velocity at which the modifying agent is introduced into the pieces is increased.

Once the digging and mixing steps are complete, the soil processing tool is withdrawn. Depending on the particular application, the tool can be withdrawn with or without excavating the admixture of modifying agent and material from the situs. If it is necessary to form a cavity in the situs for the installation of a pipe pile or other structural element therein, some of the admixture of modifying agent and material can be excavated from the situs or the cavity can be drilled to a depth sufficient to contain the volume of displaced modifying agent and material. The cavity can be filled with a solidifying agent such as concrete to form a pile or wall in situ, or a preformed pile or other structural element can be installed therein. If it is not necessary to form a cavity in the situs, the tool is withdrawn in a way that leaves substantially all of the modifying agent/material admixture therein. If the tool employed is an auger or other drill-type tool, it can be withdrawn from the situs without excavating a substantial amount of the modifying agent/material admixture therefrom by reverse rotation.

In accordance with the method of the second aspect of the present invention, the structural integrity of material in the situs is first modified in accordance with the first aspect of the present invention. Once the digging and mixing steps are complete, the auger is withdrawn from the situs leaving a cavity in the situs having a substantial portion of the admixture of modifying agent and material therein, and a preformed structural element is placed in the cavity whereby at least a portion of the admixture of the modifying agent and material is displaced by the element and forced between the element and the wall of the cavity. If the preformed structural element is a pipe pile, a portion of the admixture of the modifying agent and material is forced inside the pile as well. Inasmuch as the load-bearing capacity of both the preformed structural element and the material in the situs can be determined before the structural element is installed and before the admixture of the modifying agent and material hardens, the final load-bearing capacity of the structural element as installed in the situs can be accurately controlled. The structurally enhanced environment surrounding the structural element reduces the required length and width of the structural element and increases the lateral strength thereof.

The method of the second aspect of the present invention is particularly suitable for installing pre-stressed concrete piles, pipe piles, H-beams and specially designed structural elements in subterranean earth situs. The method can be used to install driven piles without the need for heavy impact pile hammers and the smoke, noise, shockwaves and vibration associated therewith. Piers can be installed without the need for drill casings or steel reinforcement cages. The method allows structural elements to be easily installed in all types of earth situs, even if the situs are offshore. Inasmuch as the final load-bearing capacity and strength of the element can be determined before the element is actually installed, many of the uncertainties associated with bidding for pile installation jobs are eliminated.

Referring now to the drawings, the methods of the present invention will be further described. First, as shown in FIG. 1, an auger 10 comprising a hollow shaft 12, a helical flight 14, a cutting tip 16 and a plurality of injection nozzles 18 is rotated by auger drive means 20 into a subterranean earth situs 22 to break material 23 forming the situs into a plurality of pieces 26. While the auger 10 is rotated into the situs 22, a modifying agent is hydraulically admixed with the pieces 26 by introducing the modifying agent into the pieces at a velocity in the range of from about 300 ft./sec. to about 2500 ft./sec. The pieces 26 are divided into very fine particles and a uniform admixture 28 of the modifying agent and the particles is formed.

The modifying agent is pumped from a source 30 thereof through the shaft 12 and injection nozzles 18 of the auger 10 into the pieces 26 by a high-pressure pump 32. A signal 34 corresponding to the rate of rotation of the auger 10, a signal 36 corresponding to the velocity at which the modifying agent is introduced into the pieces 26 and one or more signals 38 corresponding to one or more properties of the material 23 in the situs 22 are provided to a computer 40. The computer 40 calculates the required rates of rotating the auger 10 and introducing the modifying agent in the situs 22 to achieve the desired load-bearing capacity of the material 23 and provides a signal 42 to the auger drive means 20 and a signal 44 to the high-pressure pump 32 to regulate the rate of rotation of the auger and the velocity at which the modifying agent is introduced into the situs in accordance therewith.

Figure 2:
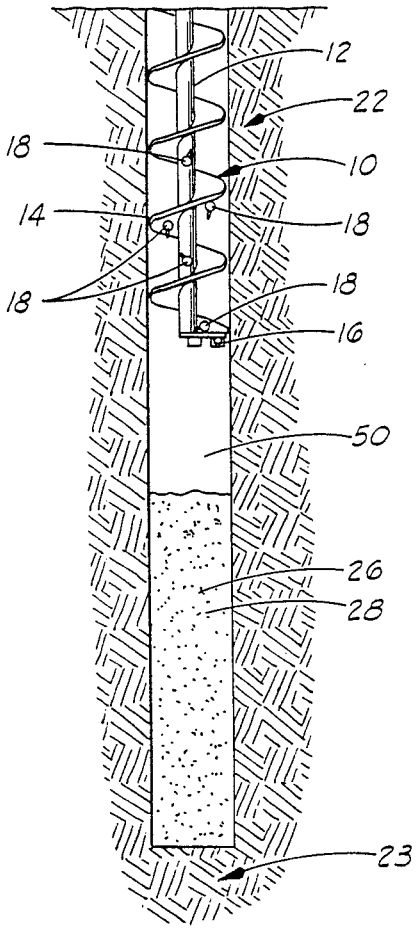
FIG. 2 illustrates rotation of a hollow-shafted auger out of a subterranean earth situs in accordance with the methods of the present invention.
Figure 3:
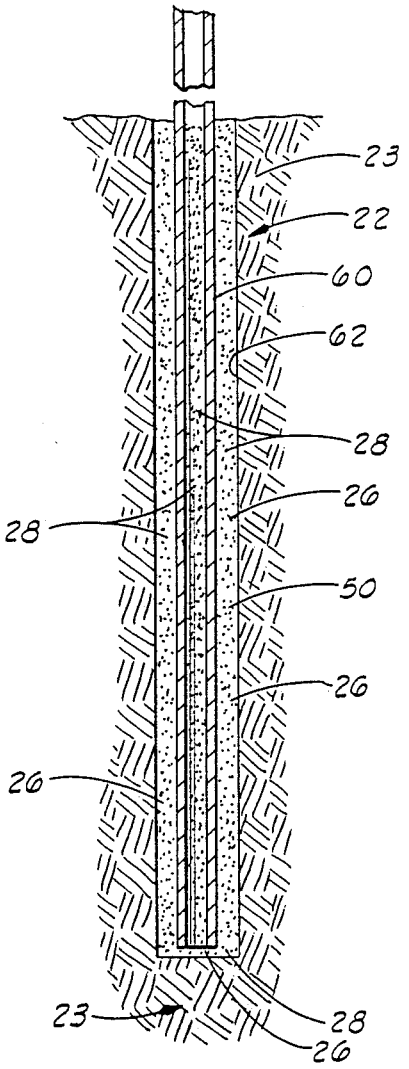
FIGS. 3 and 4 illustrate installation of a preformed structural element into subterranean earth situs in accordance with the method of the second aspect of the present invention.

As shown in FIG. 2, once the desired load-bearing capacity of the material 23 in the situs 22 is achieved, the direction of rotation of the auger 10 is reversed to withdraw the auger from the situs leaving a cavity 50 in the situs having a substantial portion of the admixture 28 of modifying agent and material therein. As shown in FIG. 3, a pipe pile 60 is placed in the cavity whereby at least a portion of the admixture 28 of the modifying agent and material is displaced by the pile and forced between the pile and the wall 62 of the cavity. A portion of the admixture 28 of the modifying agent and material is forced inside the pipe pile 60 as well. The admixture 28 of the modifying agent and material is then allowed to harden.

Figure 4:
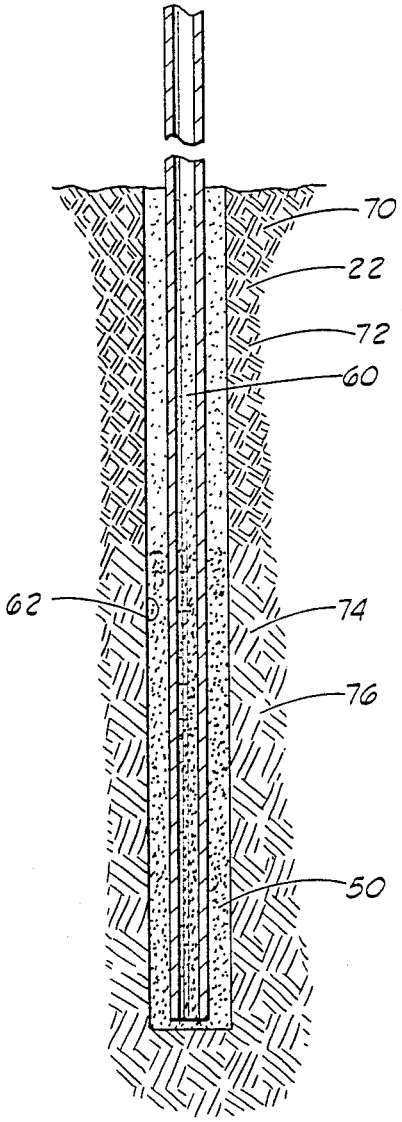

FIG. 4 illustrates the installation of a pipe pile in a subterranean earth situs 22 having different types of material therein. The upper portion 70 of the situs 22 contains loose, non-consolidated material 72. The lower portion 74 of the situs 22 contains relatively firm, consolidated material 76. The structural integrity of the material 72 has been decreased while the structural integrity of the material 76 has been increased.

The following example is provided to further illustrate the methods of the present invention.

EXAMPLE

The method of the present invention is used to increase the load-bearing capacity of soil in a subterranean earth situs and install a metal pipe therein.

The method is carried out with a soil processing tool having a single helix with a hollow shaft, a cutting tip and two injection nozzles. The soil processing tool is 6 feet long and has a 16 diameter. The injection nozzles are disposed on the helix and directed outwardly and perpendicularly therefrom. The first injection nozzle is disposed on the helix approximately two inches above and 10 degrees behind the cutting tip. The second injection nozzle is disposed on the helix opposite to and 14 inches above the first injection nozzle. Both injection nozzles have diameters of approximately 2 millimeters.

The modifying agent used to carry out the method is a Portland cement/water slurry having a density of about 12.5 pounds per gallon. The soil forming the situs consists predominantly of fine silty sand that contains about 3 to 5 percent clay and 12 to 18 percent water. The soil is compacted to a 90 percent proctor.

The soil processing tool is rotated into the situs to a depth of approximately 15 feet. The modifying agent is pumped through the shaft and injection nozzles of the tool and admixed with the pieces of soil broken up by the tool as the tool is advanced. The modifying agent is introduced into the pieces at a pressure and velocity sufficient to divide the pieces into very fine particles and form a uniform admixture of the modifying agent and particles.

A computer is employed to determine the rates of advancing the soil processing tool into the situs and introducing the modifying agent into the pieces of soil necessary to achieve the desired load-bearing capacity of the soil. Typically, the soil processing tool is rotated at about 125 rpm and the modifying agent is introduced into the pieces of soil at a velocity in the range of from about 600 to about 700 ft./sec.

Next, the direction of rotation of the soil processing tool is reversed to withdraw the tool from the situs leaving a cavity in the situs having a substantial portion of the admixture of modifying agent and soil particles therein. A 19 foot long metal pipe having a wall thickness of 0.25 inch and a diameter of 6 inches is then centered in the hole, lowered into position and allowed to cure.

After 28 days, the pull out capacity or frictional shear strength at the interface between the original soil and modifying agent/soil column is tested. It is determined that the strength of the pipe is at least equal to the strength that similar pipes cast by conventional methods in the same soil would have.

The preceding example can be repeated with similar success by substituting the generically or specifically described steps and operating conditions of this invention for those used in the Example.

Although certain preferred embodiments of the invention have been described for illustrative purposes, it will be appreciated that various modifications and innovations of the methods recited herein may be effected without departure from the basic principals which underlie the invention. Changes of this type are therefore deemed to lie within the spirit and scope of the invention except as may be necessarily limited by the inventive claims and reasonable equivalents thereof.

What is claimed is:

1. A method of strengthening and improving the load bearing capacity of material in a subterranean earth situs comprising:

advancing a soil processing tool into said situs to break said material into pieces; and while advancing said soil processing tool into said situs, introducing a solidifying agent into said pieces from said tool at a velocity in the range of from about 300 ft./sec. to about 2500 ft./sec. to hydraulically divide said pieces into very fine particles and admix said solidifying agent with said particles whereby a uniform admixture of said solidifying agent and said material is achieved; and allowing said admixture of said solidifying agent and said material to harden.

2. The method of claim 1 wherein said solidifying agent is a solidifying agent selected from the group consisting of flyash and Portland cement.

3. The method of claim 1 wherein said solidifying agent is introduced into said pieces at a velocity in the range of from about 500 ft./sec. to about 1100 ft./sec.

4. The method of claim 1 wherein said soil processing tool is an auger having a hollow shaft and an injection nozzle attached to said shaft and in fluid communication therewith, and wherein said solidifying agent is introduced into said pieces from said nozzle.

5. The method of claim 1 further comprising the steps of analyzing said material to determine at least one property thereof and separately regulating the rates of advancing said soil processing tool into said situs and introducing said solidifying agent into said pieces based on the analysis.

6. The method of claim 5 wherein said step of analyzing said material to determine at least one property thereof is carried out simultaneously with the steps of advancing said soil processing tool into said situs and introducing said solidifying agent into said pieces.

7. A method of strengthening and improving the load bearing capacity of material in a subterranean earth situs and installing a preformed structural element therein comprising:

advancing a soil processing tool into said situs to break said material into pieces;

while advancing said soil processing tool into said situs, introducing a solidifying agent into said pieces from said tool at a velocity in the range of from about 300 ft./sec. to about 2500 ft./sec. to hydraulically divide said pieces into very fine particles and admix said solidifying agent with said particles whereby a uniform admixture of said solidifying agent and said material is achieved;

withdrawing said soil processing tool from said situs leaving a capacity in said situs having a substantial portion of said admixture of solidifying agent and material therein; and placing said preformed structural element in said cavity whereby at least a portion of said admixture of said solidifying agent and material is displaced by said element and forced between said element and the wall of said cavity; and allowing said admixture of said solidifying agent and said material to harden.

8. The method of claim 7 wherein said solidifying agent is Portland cement.

9. The method of claim 7 wherein said solidifying agent is introduced into said pieces at a velocity in the range of from about 500 ft./sec. to about 1100 ft./sec.

10. The method of claim 7 wherein said soil processing tool is an auger having a hollow shaft and an injection nozzle attached to said shaft and in fluid communication therewith, and wherein said solidifying agent is introduced into said pieces from said nozzle.

11. The method of claim 7 further comprising the steps of analyzing said material to determine at least one property thereof and separately regulating the rates of advancing said soil processing tool into the situs and introducing said solidifying agent into said pieces based on the analysis.

12. The method of claim 11 wherein said step of analyzing said material to determine at least one property thereof is carried out simultaneously with the steps of advancing said soil processing tool into said situs and introducing said solidifying agent into said pieces.

13. The method of claim 7 wherein said preformed structural element is a pipe pile.

* * * * *